US005826801A

United States Patent [19]

Kobayashi et al.

[11] Patent Number: 5,826,801

[45] Date of Patent: Oct. 27, 1998

[54] FUEL INJECTION VALVE FOR ENHANCING PENETRATION SPRAY OF INJECTED FUEL IN AN INTERNAL COMBUSTION ENGINE

[75] Inventors: Mitsuaki Kobayashi; Fumitsugu Yoshizu, both of Saitama-ken, Japan

[73] Assignee: Zexel Corporation, Tokyo, Japan

[21] Appl. No.: 594,755

[22] Filed: Jan. 31, 1996

[30] Foreign Application Priority Data

Feb. 20, 1995 [JP] Japan ..... 7-055077

[51] Int. Cl.[6] ..... F02M 61/08

[52] U.S. Cl. ..... 239/533.4; 239/533.12

[58] Field of Search ..... 239/533.4, 533.7, 239/533.9, 533.12, 584

[56] References Cited

FOREIGN PATENT DOCUMENTS 2451462 5/1976 Germany .
3300953 1/1982 Germany .
4444363 6/1996 Germany .
60-14932 1/1982 Japan .
60-14932 5/1985 Japan .

*Primary Examiner*—Lesley D. Morris

[57] ABSTRACT

A stem of a poppet valve of a fuel injection nozzle has a plurality of first injection ports and a plurality of second injection ports formed in an area in the vicinity of a valve portion of the poppet valve. One open end of the first injection ports are spacedly circumferentially aligned. One open end of the second injection ports are likewise spacedly circumferentially aligned. The one open end of the first injection ports are located downwardly of the one end of the second injection ports. The one open end of the first and second injection ports are axially aligned. When an engine is revolving at a low speed, fuel is injected from only the first injection ports, and when the engine is revolving at a high speed, fuel is injected from the first and second injection ports.

2 Claims, 2 Drawing Sheets

FUEL INJECTION VALVE FOR ENHANCING PENETRATION SPRAY OF INJECTED FUEL IN AN INTERNAL COMBUSTION ENGINE

BACKGROUND OF THE INVENTION

This invention relates to a fuel injection nozzle with a poppet valve.

One typical fuel injection nozzle of this type includes a nozzle body, and a poppet valve axially slidably received in the nozzle body. The poppet valve includes a stem, and a valve portion of an enlarged diameter formed at a lower end thereof. The stem has a plurality of injection ports formed in an area in the vicinity of the valve portion. The poppet valve is upwardly biased by a spring, and its valve portion sits on a lower end of the nozzle body. When the valve is in the sitting state, the injection ports are blocked with a peripheral wall of the nozzle body. When the poppet valve is subject to a fuel pressure from a fuel injection pump, it is moved downwardly. The fuel injection ports are opened at that time, and the fuel is injected into an engine combustion chamber from the injection ports.

In a fuel injection nozzle disclosed in Japanese Utility Model Publication No. 14932/85, the injection ports include a plurality of first injection ports and a plurality of second injection ports. One open end of the first injection ports are generally equally located when viewed in a direction of an axis of the poppet valve and are spacedly arranged in the circumferential direction. One open end of the second injection ports are also generally equally located when viewed in the direction of the axis of the poppet valve, and are spacedly arranged in the circumferential direction. The open end of the first injection ports are located downwardly of the open end of the second injection ports. The open ends of the first and second injection ports are spacedly arranged in the circumferential direction.

In the nozzle of the above Publication, since fuel pressure to be supplied to a fuel pool chamber is low when the engine is revolving at a low speed, the lifting amount of the poppet valve is small and the first injection ports are opened but the second injection ports remain closed. As a consequence, the fuel from only the first injection ports is injected, and the total opening area through which the fuel is injected can be restrained to a small amount. For this reason, the fuel can be atomized. Since the fuel pressure is high in the fuel pool chamber when the engine is revolving at a high speed, the lifting amount of the poppet valve is large and both the first and second injection ports are opened. As a consequence, fuel is injected from both the first and second injection ports. For this reason, a sufficient amount of fuel can be injected.

However, with the above construction, the combustion efficiency is low when the engine revolves at a high speed. As a result of hard study by the present inventor, the following conclusion is reached; "Since the penetration of the fuel to be injected is small, the whole air in the engine combustion chamber cannot be used efficiently and the combustion efficiency is low". The reasons why this penetration is low are as follows. Since the number of the injection nozzles which inject fuel is increased, the amount of fuel injected from each fuel injection is small. Further, all the injection ports are spacedly arranged in the circumferential direction and therefore, fuel is injected from the respective injection ports without being interfered.

According to the present invention, a fuel injection nozzle comprising a nozzle body extending axially with a guide hole opening at a lower end and a fuel pool chamber at an upper location of the guide hole is provided. A poppet valve including a stem is axially slidably received in the guide hole of the nozzle body. A valve portion is formed on a lower end of the stem, the diameter of the valve portion being larger than that of the stem and the valve portion being faced with the lower end of the nozzle body.

The stem is provided with a plurality of first injection ports and a plurality of second injection ports formed in an area in the vicinity of the valve portion. Each injection port has a first end and a second end, the first ends of the first and second injection ports being open at an outer peripheral surface of the stem and the second ends being in communication with the fuel pool chamber through a fuel passageway formed in the stem. The first ends of the first injection ports are spacedly circumferentially aligned. Likewise, the first ends of the second injection ports are generally spacedly circumferentially aligned, the first ends of the second injection ports being located downwardly of the first ends of the second injection ports and the first ends of the first and second injection ports being generally axially aligned, wherein an axis of the first injection port and an axis of the second injection port extend generally in parallel relation.

The poppet valve is normally upwardly biased by a first spring so that the valve portion of the poppet valve sits on the lower end of the nozzle body. When the valve portion sits on the lower end of the nozzle body, the first and second injection ports are blocked by a peripheral wall of the nozzle body which defines the guide hole. When a fuel pressure which is higher than a first pressure level but lower than a second pressure level is supplied to the fuel pool chamber, the poppet valve moves downwardly against the first spring, thereby opening the first injection ports. The extent of the downward movement of the first spring is controlled by a second spring so that the second injection ports remain closed. When a fuel pressure which is higher than the second pressure level is supplied to the fuel pool chamber, the poppet valve is moves downwardly against the first and second springs so that both the first and second injection ports are opened and fuel is injected from both the first and second injection ports. The arrangement of the fuel injection ports enhances the fuel combustion efficiency when the engine is operating at both low and high speeds.

DETAILED DESCRIPTION OF THE EMBODIMENT

Figure 1:
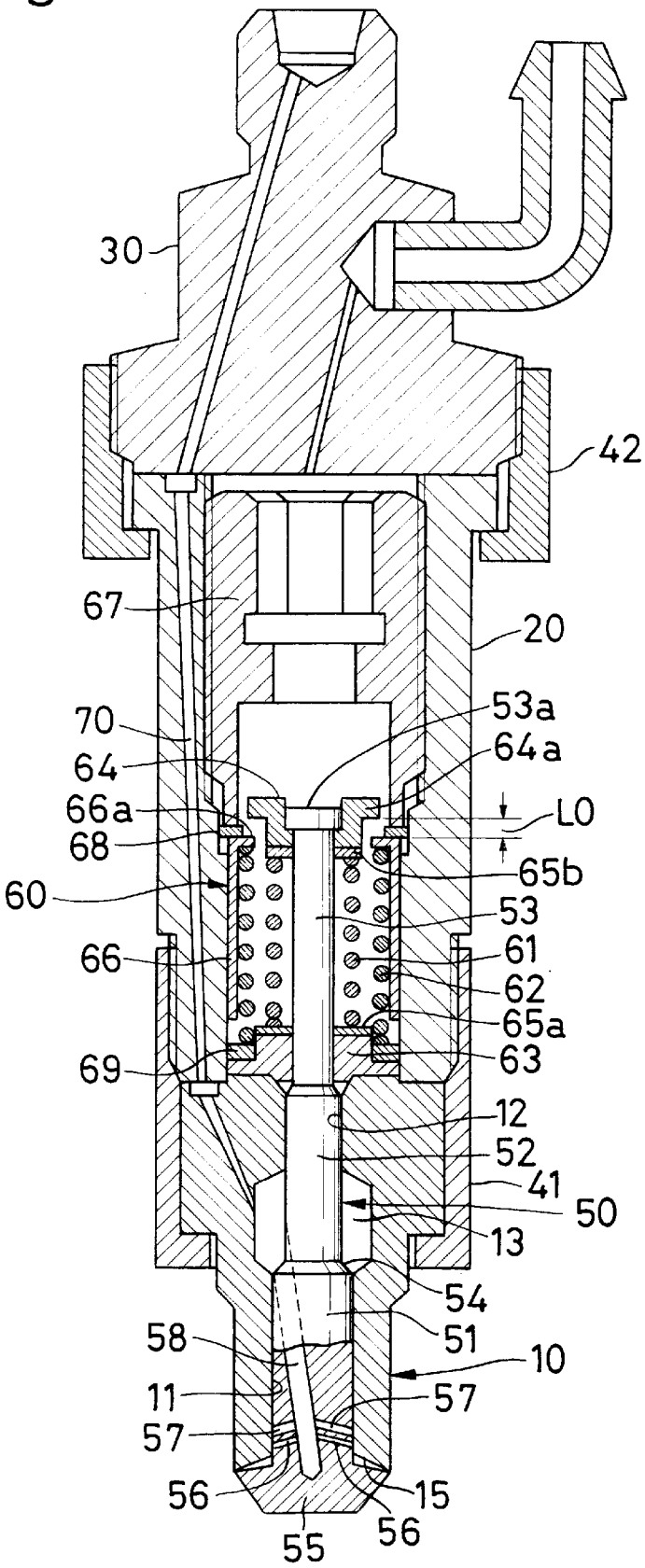
FIG. 1 is a vertical section view of a fuel injection nozzle according to one embodiment of the present invention.

A fuel injection nozzle according to one embodiment of the present invention will now be described with reference to the accompanying drawings. As shown in FIG. 1, an elongated fuel injection nozzle includes a nozzle body 10, a nozzle holder 20, and a joint 30 axially arranged in this order from below. The nozzle body 10 is attached to a lower end of the nozzle holder 20 by a nut 41, and the joint 30 is attached to an upper end of the nozzle holder 20 by a nut 42.

The fuel injection nozzle includes a poppet valve 50 axially slidably received in the nozzle body 10, and a spring mechanism 60 adapted to bias the poppet valve 50 upwardly.

Next, the detailed construction of each component portion will be described. First, the nozzle body 10 will be described. The nozzle body 10 is provided with a lower and an upper portion respectively with a first guide hole 11 and a second guide hole 12 extending axially. The first guide hole 11 is larger in diameter than the second guide hole 12. The first guide hole 11 is opened at a lower end face of the nozzle body 10 and the second guide hole 12 is opened at an upper end face of the nozzle body 10. The lower end of the nozzle body 10 is tapered and serves as a valve seat 15 as later described. Between the guide holes 11 and 12, a fuel pool chamber 13 is formed. Fuel, which is pressurized by a fuel injection pump (not shown), is fed via a fuel passageway 70 extending through the joint 30, the nozzle holder 20 and the nozzle body 10.

The poppet valve 50 includes a first stem 51, a second stem 52, and a third stem 53 linearly arranged in this order from below. The first stem 51 has the largest diameter and the third stem 53 has the smallest. The first stem 51 and the second stem 52 are slidably received in the first guide hole 11 and the second guide hole 12 of the nozzle body 10, respectively. A stepped portion 54 is formed between the first stem 51 and second stem 52 of the poppet valve 50. This stepped portion 54 is provided as a pressure receiving portion facing the fuel pool chamber 13. The first stem 51 is provided at a lower end thereof with a valve portion 55 which is larger in diameter than the first stem 51. The valve portion 55 is located downwardly of the nozzle body 10 and faced with the valve seat 15 of the nozzle body 10.

The spring mechanism 60 is received in a sleeve-like nozzle holder 20 and includes first and second springs 61 and 62 coaxial with the one another. The first spring 61 is smaller in diameter than the second spring 62.

The third stem 53 of the poppet valve 50 is allowed to extend through a lower spring seat 63 placed on an upper end face of the nozzle body 10 and further extend upwardly through the nozzle holder 20. The first stem 53 has an engagement flange 53*a* formed on an upper end thereof. An upper spring seat 64 is in engagement with the engagement flange 53*a*. Between the spring seats 63 and 64, the first spring 61 is interposed in its compressed state. Under the effect of the first spring 61, the poppet valve 50 is biased normally upwardly and the valve portion 55 is caused to sit on the seat 15. When the fuel pressure received by the pressure receiving portion 55 has exceeded the initial valve opening pressure, the poppet valve 50 is lifted downwardly against the first spring 61. The bias of the first spring 61 can be adjusted by shims 65*a* and 65*b*. An annular engagement portion 64*a* is formed on the upper spring seat 64 in such a manner as to project radially outwardly. Operation of this engagement portion 64*a* will be described later.

The bias mechanism 60 further includes a sleeve-like slide member 66. This slide member 66 is axially slidably received in the nozzle holder 20. The slide member 66 has an annular spring retainer 66*a* projecting radially inwardly from an upper end thereof. Between the spring retainer 66a and the lower spring seat 63, the second spring 62 is interposed in its compressed state.

The slide member 66 is biased upwardly by the second spring 62. Any further upward movement of the slide member 66 is restricted by a sleeve-like stopper 67 threadedly engaged with an upper portion of the noise holder 20. That is, the upper end of the slide member 66 is in engagement with a lower end of the stopper 67 through a shim 68.

As shown in FIG. 1, in the state that the valve portion 55 of the poppet valve 50 sits on the valve seat 15 and the slide member 66 is in engagement with the stopper 67, the engagement portion 64*a* of the upper spring seat 64 is separated upwardly from the spring retainer 66*a* of the slide member 66. This distance of separation is denoted by reference numeral LO in FIG. 1.

When the fuel supply pressure has exceeded the initial valve opening pressure to lift the poppet valve 50 downwardly an amount corresponding to the separation distance LO, the engagement portion 64*a* of the upper spring seat 64 is brought into abutment with the spring retainer 66*a* of the slide member 66 located at its upper extremity. For this reason, the poppet valve 50 is subjected to resistance not only of the first spring 61 but also of the second spring 62. When the fuel supply pressure exceeds a main valve opening pressure, the poppet valve 50 is further lifted from the engagement position because it overcomes the effects of the first and second springs 61 and 62. The maximum lifting amount of the poppet valve 50 is determined when a lower end of the slide member 66 is brought into abutment with the shim 69. It should be noted that the bias of the second spring 62 is adjusted by the shim 69.

Figure 2:
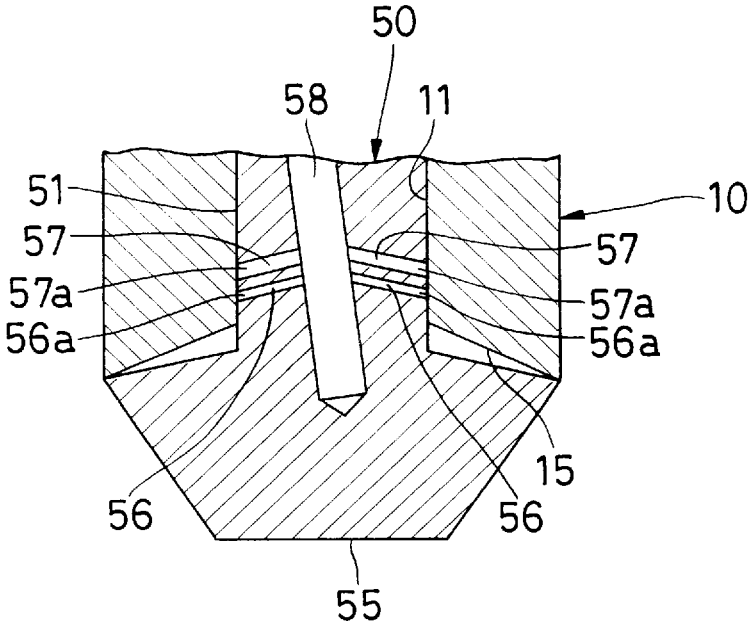
FIG. 2 is a sectional view showing, on an enlarged basis, lower end portions of a poppet valve and a nozzle body.
Figure 3:
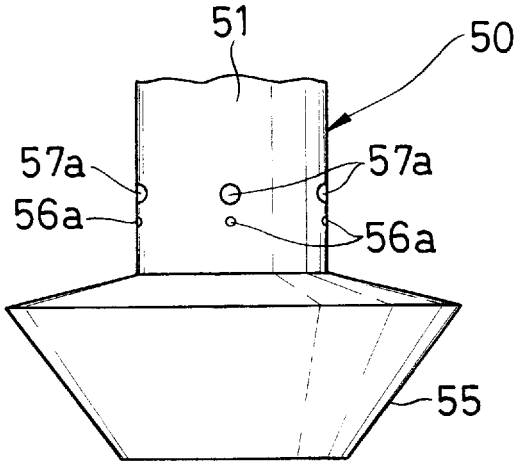
FIG. 3 is a side view showing, on an enlarged basis, the lower end portion of the poppet valve.

Next, the poppet valve 50 will be described. As shown in FIGS. 2 and 3, the first stem 51 of the poppet valve 50 has a plurality (four, for example) of first injection ports 56 and a corresponding number of second injecting holes 57, which are all formed in an area in the vicinity of the valve portion 55. One end 56*a* and 57*a* of the injection ports 56 and 57 are opened at an outer peripheral surface of the first stem 51, whereas the other ends are in communication with the fuel pool chamber 13 via the fuel passage 58 formed in the first stem 51.

The open ends 56*a* of the first injection ports 56 are located downwardly of the open ends 57*a* of the second injection ports 57. The open ends 56*a* of the first four injection ports 56 are spacedly circumferentially aligned, i.e., equally located when viewed in an axial direction of the poppet valve 50 and arranged at equal spaces in the circumferential direction. Likewise, the open ends 57*a* of the second four injection ports 57 are circumferentially aligned at equal spaces.

The injection ports 56 and 57 are inclined downwardly as they go radially outwardly. In this embodiment, the angles of inclination of all the injection ports 56 and 57 are equal with respect to the axis of the poppet valve 50.

The first four injection ports 56 and the second four injection ports 57 are axially aligned, i.e., equally located when viewed in the circumferential direction of the poppet valve 50. The axis of each injection port 56 and the axis of a corresponding injection port 57 are in parallel relation and slightly spaced apart from each other in the axial direction of the poppet valve 50. Thus, the open ends 56*a* and 57*a* of the pair of injection ports 56 and 57 are axially aligned in proximal relation. The first injection ports 56 are smaller in diameter than the second injection ports 57.

In the state that the valve portion 55 of the poppet valve 50 sits on the valve seat 15, both the first and second injection ports 56 and 57 are blocked with a peripheral wall (the wall defining the first guide hole 11) of the nozzle body 10. When the poppet valve 50 is lifted an amount corresponding to the distance LO between the engagement portion 64*a* and the spring retainer 66*a*, the first injection ports 56 are fully opened but the second injection ports 57 remain blocked. When the poppet valve 50 is fully lifted, both the first and second injection ports 56 and 57 are fully opened.

Fuel is intermittently fed, under pressure, to the fuel injection nozzle thus constructed from a fuel injection pump driven by the engine. When the engine is revolving at a low speed, the fuel pressure supplied to the fuel pool chamber 13 exceeds the initial valve opening pressure but it does not reach the main valve opening pressure. Since the poppet valve 50 is subjected to resistance of the second spring 62, it is lifted only the predetermined lift amount LO (i.e., the lift amount corresponding to the distance between the engagement portion 64*a* of the upper spring seat 64 and the spring retainer 66*a* of the slide member 66) and it is not lifted any further. As a consequence, fuel is injected only from the first injection ports 56, thus enabling to atomize the fuel. Moreover, owing to the feature that the first injection ports 56 have a comparatively small diameter, the fuel injected from the injection ports 56 are injected in a more finely atomized fashion. This makes it possible to increase the contact area between the fuel and the air in the engine combustion chamber. As a consequence, the combustion efficiency of fuel is further improved.

When the engine is revolving at a high speed, the poppet valve 50 is, as in the case with the engine revolving at a low speed, lifted when the fuel pressure exceeds the initial valve opening pressure, and the engagement portion 64*a* of the upper spring seat 64 is brought into abutment with the spring retainer 66*a* of the slide member 66. Thereafter, when the fuel pressure exceeds the main valve opening pressure, the poppet valve 50 is further lifted against the effects of the first and second springs 61 and 62. When the engine is revolving at a high speed, since the fuel pressure is abruptly increased, the poppet valve 50 is not stopped at the predetermined amount LO. Instead, it is continuously lifted until it is fully lifted. As a consequence, fuel is injected from both the first and second injection ports 56 and 57. Owing to the features that the open ends 56*a* and 57*a* of the pair of injection ports 56 and 57 are arranged in the same location in the circumferential direction and therefore, the distance between the open ends 56*a* and 57*a* is much smaller than the conventional arrangement in which the open ends are spacedly arranged in the circumferential direction, the fuel injected from the pair of injection ports 56 and 57 is almost like one which is injected from a single injection port having a sectional area equal to that of a combination of two injection ports 56 and 57. Accordingly, the penetration of fuel injection can be enhanced. Since the axes of each pair of injection ports 56 and 57 are in parallel relation, the penetration is further enhanced. This makes it possible to effectively utilize the whole air in the combustion chamber and to improve the combustion efficiency.

The present invention is not limited to the above embodiment but many changes can be made. For example, the pair of injection ports 56 and 57 may have the same diameter.

A third injection port may be employed in addition to the first and second injection ports. In this case, the third injection port is spacedly arranged in the axially direction of the poppet valve 50 with respect to the second injection ports.

One pair of injection ports 56 and 57 may be inclined at a different angle with another pair of such injection ports. Also, the pair of injection ports 56 and 57 may be horizontally formed instead of being inclined slantwise downwardly. Similarly, they may be inclined slantwise upwardly.

What is claimed is:

1. A fuel injection nozzle comprising:

(a) a nozzle body extending axially, having a guide hole opening at a lower end thereof, and a fuel pool chamber disposed at an upper location of said guide hole;

(b) a poppet valve including a stem axially slidably received in said guide hole of said nozzle body, and a valve portion formed on a lower end of said stem and having a diameter larger than that of said stem, said valve portion being faced with the lower end of said nozzle body, said stem being provided with a plurality of first injection ports and a plurality of second injection ports formed in an area in the vicinity of said valve portion, each injection port having a first end and a second end, said first ends of said first and second injection ports being open at an outer peripheral surface of said stem and said second ends being in communication with said fuel pool chamber through a fuel passageway formed in said stem, said first ends of said first injection ports being spacedly circumferentially aligned, said first ends of said second injection ports being likewise generally spacedly circumferentially aligned, said first ends of said second injection ports being located downwardly of said first ends of said second injection ports, said first ends of said first and second injection ports being generally axially aligned, and wherein an axis of said first injection port and an axis of said second injection port extend in generally parallel relation; and (c) a first and a second spring, said poppet valve being normally upwardly biased by said first spring, so that said valve portion sits on the lower end of said nozzle body, when said valve portion being in a sitting-state, said first and second injection ports being blocked with a peripheral wall of said nozzle body which defines said guide hole, when a fuel pressure, which is higher than a first pressure level but lower than a second pressure level, is supplied to said fuel pool chamber, said poppet valve being moved downwardly against said first spring, thereby opening said first injection ports to inject fuel from said first injection ports, in this case said poppet valve being prevented from being lifted more than a predetermined lift amount by said second spring so that said second injection ports are closed, when a fuel pressure, which is higher than said second pressure level, is supplied, said poppet valve being moved downwardly extending said predetermined lift amount against both of said first and second springs so that not only first injection ports but also said second injection ports are opened and fuel are injected from both of said first and second injection ports.

2. A fuel injection nozzle according to claim 1, in which said first injection ports have a smaller section than said second injection ports, respectively.

* * * * *

UNITED STATES PATENT AND TRADEMARK OFFICE

CERTIFICATE OF CORRECTION

PATENT NO. : 5,826,801

DATED : October 27, 1998

INVENTOR(S) : Mitsuaki KOBAYASHI et al.

It is certified that error appears in the above-identified patent and that said Letters Patent is hereby corrected as shown below:

In the Claims:

In Claim 1, column 6, line 24, "second" should be --first--.

Signed and Sealed this

Thirtieth Day of March, 1999

*Attest:*

Q. TODD DICKINSON

*Attesting Officer*

*Acting Commissioner of Patents and Trademarks*